United States Patent [19]

Gamble

[11] Patent Number: 4,640,011

[45] Date of Patent: Feb. 3, 1987

[54] NAIL CLIPPER

[75] Inventor: William L. Gamble, Unionville, Conn.

[73] Assignee: The W. E. Bassett Company, Derby, Conn.

[21] Appl. No.: 760,460

[22] Filed: Jul. 30, 1985

[51] Int. Cl.[4] ..... A45D 29/00

[52] U.S. Cl. ..... 30/28; 30/26; 132/73.5

[58] Field of Search ..... 30/28, 124, 26; 132/73, 132/73.5

[56] References Cited

U.S. PATENT DOCUMENTS

| | | | |
|---|---|---|---|
| 2,179,435 | 11/1939 | Smith | 30/28 |
| 2,887,773 | 5/1959 | Killen | 30/28 |
| 3,031,754 | 5/1962 | Pocoski | 30/28 |
| 3,154,850 | 11/1964 | Okuno | 30/28 |
| 3,180,025 | 4/1965 | Tsunemi | 30/28 |

*Primary Examiner*—E. R. Kazenske
*Assistant Examiner*—Willmon Fridie, Jr.
*Attorney, Agent, or Firm*—Hopgood, Calimafde, Kalil, Blaustein & Judlowe

[57] ABSTRACT

The invention contemplates a single-piece clippings retainer having snap-action assembly to a conventional nail clipper, of the variety in which elongate jaw members are connected at one end and diverge toward their other end. The single-piece retainer comprises a mounted end and an actuable end, with an integrally formed hinge connection therebetween. The actuable end has side panels to effectively close the sides of the space between jaw members when releasably retained in its "up" position; when the actuable end is released and downwardly hinged, the open sides of the space between jaw members is exposed, and accumulated clippings can be discharged under control, i.e., without scatter.

6 Claims, 4 Drawing Figures

NAIL CLIPPER

BACKGROUND OF THE INVENTION

The invention relates to nail clippers, such as fingernail clippers and toenail clippers, of the variety in which like elongate jaw members are secured to each other at one end and diverge in the direction of their opposite ends, where opposed cutting edges are actuable.

It has always been a problem, in using such clippers, that both hands are occupied, in that one hand is holding and actuating the clipper, while the nails of the other hand are being clipped. For this reason, clippings are unrestrained and can disperse in any and all directions.

Various forms of devices have been proposed to avoid loss of clippings, but for one reason or another they have not seen public acceptance. For example, in one variety, a plastic sock is removably assembled to the clipper over the secured end of the jaw member, but this must be retracted or disassembled, in order to free accumulated clippings for release and disposal from the space between jaw members.

BRIEF STATEMENT OF THE INVENTION

It is an object of the invention to provide an improved means of releasably retaining clippings in use of clippers of the character indicated.

A specific object is to meet the above object with a simple inexpensive single-piece injection-moldable retainer device which retains its assembled relation to a nail clipper and yet provides selectively operable means for enabling controlled discharge of accumulated clippings from the space between jaw members.

The invention achieves the foregoing objects in an injection-moldable single-piece structure involving effectively a hinge connection between (1) a mounting end, which is retained in place by snap-action detent engagement to the connected end of the jaw members, and (2) an actuable end which has side panels to effectively close the sides of the space between jaw members when releasably retained in its "up" position; when the actuable end is released and downwardly hinged, the open sides of the space between jaw members are exposed, and accumulated clippings can be discharged under control, i.e., without scatter.

DETAILED DESCRIPTION

The invention will be described in detail for a preferred embodiment, in conjunction with the accompanying drawings, in which.

Figure 1:
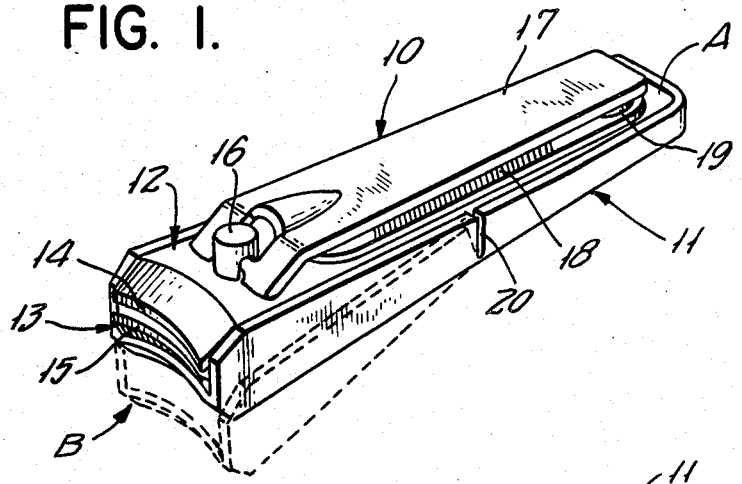
FIG. 1 is a perspective view of a nail clipper, to which a clippings retainer of the invention has been assembled.

The clipper 10 of FIG. 1, to which the retainer 11 of the invention is assembled, may be a standard commercially available device, as for example shown and described in U.S. Pat. No. 2,477,782 Such clippers comprise two like elongate jaw members 12–13, secured to each other as by welding at their connected end A, and diverging from each other in the direction of their cutting end B. At the cutting end B, each jaw member is inwardly bent, and confronting cutting edges 14–15 are ground. A rivet 16 extends through aligned apertures in both jaw members, the rivet head (not shown) engaging the underside of the lower jaw member 13. An actuating lever 17 is engaged to the upwardly projecting end of rivet 16 and is shown in its retracted position, folded over and aligned with the upper surface of the upper jaw member 12. The clipper shown also happens to include a filing tool 18 pivotally connected to jaw members 12–13 via an eyelet 19 at the connected end A.

In their divergence toward the cutting end B, the jaw members 12–13 define an open-sided volume or space via which, in use of the clipper, clippings can be flung at random, by reason of the snap action of edges 14–15, on successive nail cuts. The retainer 11 provides for selective closure and opening of the otherwise-open sides of this space, without dislodging the mounted assembly of the retainer 11 to the clipper.

Figure 2:
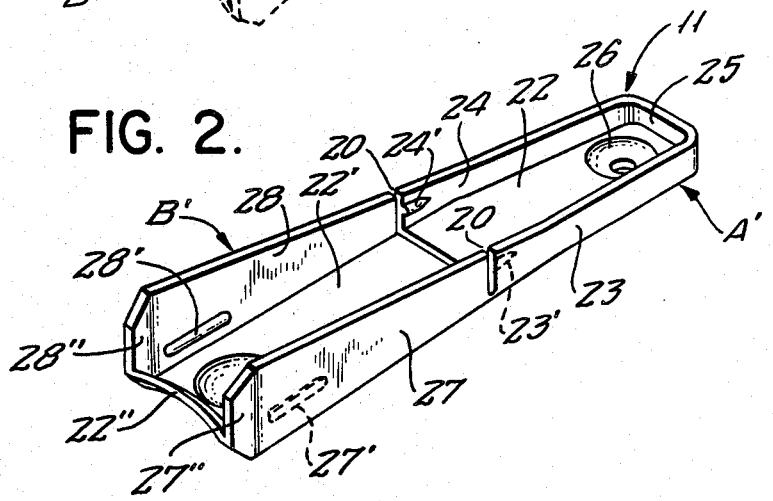
FIG. 2 is a view in perspective to show the clippings retainer alone, and from the same viewing aspect as in FIG. 1.
Figure 3:
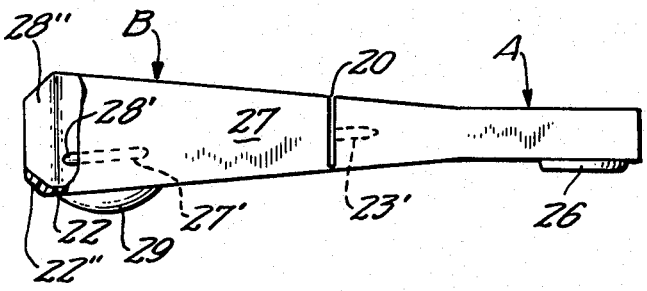
FIG. 3 is a side elevation of the retainer.
Figure 4:
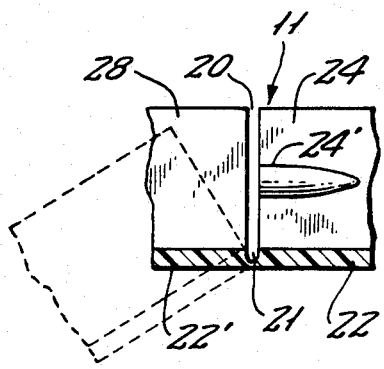
FIG. 4 is a fragmentary view, in longitudinal section and on a further enlarged scale, to show detail of the hinge region of the retainer.

The retainer 11 is seen in FIGS. 2, 3 and 4 to comprise a single-piece structure which lends itself to mass-production via injection-molding of suitable plastic, the same being selected and configurated for relatively stiff compliant retention as between base and sidewall components of its mounting end A′ and of its clippings end B′, corresponding to the respective ends A–B of the clipper.

Retainer 11 may be described as an elongate channel having a base that is common to the ends A′–B′ and having side walls which are discontinuous at a generally central longitudinal location, by reason of slits 20 to permit hinge action of end B′ with respect to end A′, and additional compliance is provided for hinge action by forming a transverse groove 21 in the channel base.

More specifically, the mounting end A′ of the retainer is a first relatively stiffly integrated structure having a base panel 22 and upstanding side panels or walls 23–24 which are connected to each other at the longitudinal end 25. Base panel 22 is contoured for conformance with the adjacent edge profile of the clipper 10, so that jaw members 12–13 will be snugly edge-lapped by the side panels 23-24-25. Base panel 22 is also shown to be locally recessed at 26 to receive that part of the eyelet 19 which extends below the lower surface of jaw member 13, so that the jaw member 13 may securely seat upon the entire area which is lapped by base panel 22. Integral inward detent formations 23′–24′ on the inner surfaces of side panels 23–24 are sufficiently spaced above base panel 22 and in the longitudinal vicinity of slits 20 that assembled engagement of the mounting end A′ to the clipper end A is by snap action of detents 23′–24′ over opposite edges of the lower jaw member 13, with the detents 23′–24′ being received in the narrowing space between jaw members 12–13. This is a positive retaining engagement of the mounting end, removable only by compliant spread of the side panels 23–24 in the course of detent disengagement from the edges of the lower jaw member 13.

The clippings end B′ is the other relatively stiffly integrated structural component of retainer 11, being connected to the mounting component A′ only via the hinge-weakened connection established by groove 21. The end B′ is seen to comprise the hinged end 22′ of base panel 22 and upstanding side panels 27–28, the upper contours of which conform to and preferably slightly lap the side edges of the upper jaw member 12, thus closing the otherwise-open sides of the space between jaw members. Phantom outlines in FIGS. 1 and 4 indicate how this space is laterally opened when the clippings end B′ is downwardly actuated. As in the case of sidewalls 23–24, the sidewalls 27–28 are characterized by detent formations 27′–28′ extending inwardly for removable snap-action engagement to and retention by the lower jaw member 13; and a rivet-head recess in base panel 22′ will be understood to account for the dome profile 29 viewable in FIG. 3, so that in the closed position of end B′ the base panel 22′ is snugly adjacent the lower surface of jaw member 13. Finally, for enhanced stiffening of the integrated relation between base panel 22′ and its sidewalls 27–28, the forward end 22″ of base panel 22′ is upturned for local conformance with ground end of jaw member 22′, and this upturned end 22″ is also integrally connected to local inwardly convergent ends 27″–28″ of the sidewall panels 27–28, the convergence of ends 27″–28″ being also in conformance with local contouring of the cutting end of jaw members 12–13.

It will be seen that the described structure meets the stated objects. The facility of use is such that the retainer 11 need not be disassembled from its clipper, and yet the hinged end B′ of the retainer can be actuated when and as often as desired between its detent-retained closed position and its opened condition of clippings dischargeability.

While the invention has been described in detail for a preferred form, it will be understood that modifications can be made without departing from the scope of the invention.

What is claimed is:

1. As an article of manufacture, a nail-clipping retainer for a nail clipper having two like elongate jaw members securely connected to each other at a connected-jaw member end and divergent longitudinally in the direction away from said connected-jaw member end, said jaw members having mutually facing and inwardly projecting coacting cutting edges at cutting ends longitudinally opposite the connected-jaw member ends thereof, thereby defining between said jaw members an open-sided cavity which converges toward said connected-jaw member end, and an actuator foldable along the outer surface of one of said jaw members and actuably connected to said jaw members for a cutting operation of said cutting edges, said retainer comprising an elongate channel of compliantly deformable material having a bottom panel conforming to the planiform of the other of said jaw members, said bottom panel being in confronting adjacency with the outer surface of said other jaw member, said channel further having like side panel connected by said bottom panel, means coacting between said jaw members and said channel for retaining said channel to said clipper at least at said connected-jaw member end, the elevational contour of said side panels above said bottom panel conforming substantially to the elevational profile of the open-sided cavity and substantially closing the same, each of said side panels having a transverse slit at a longitudinally central location, each said slit extending the width of its side panel and at least to said bottom panel, whereby said channel is characterized by a selectively movable end near said cutting ends and said selectively movable end is compliantly hinged to a retained end near said connected-jaw member end.

2. The article of claim 1, in which at least one of said side panels integrally includes, within said retained end, a detent projection extending in the direction of the other side panel and compliantly engageable over the other jaw member for releasably retaining said retainer in assembled relation to the connected-jaw member end of the nail clipper.

3. The article of claim 1, in which said side panels include, within said retained end, detent projections extending toward each other and compliantly engageable over the other jaw member for releasably retaining said retainer in assembled relation to the connected-jaw member end of the nail clipper.

4. The article of claim 2, in which at least one of said side panels integrally includes, within said selectively movable end, a detent projection extending in the direction of the other side panel and compliantly engageable over the other jaw member for releasably retaining the hinged movable end in side-closing relation with the otherwise open-sided cavity of the clipper.

5. The article of claim 3, in which said side panels include, within said movable end, detent projections extending toward each other and compliantly engageable over the other jaw member for releasably retaining the hinged movable end in side-closing relation with the otherwise open-sided cavity of the clipper.

6. The article of claim 1, in which said bottom panel is substantially uniformly thick and therefore relatively stiffly compliant, and in which said bottom panel has a transverse groove at the longitudinal locations of and extending between the slits of said side panels, whereby compliance is less stiff at the location of hinge action.

* * * * *